United States Patent [19]

Thal

[11] Patent Number: 4,944,317

[45] Date of Patent: Jul. 31, 1990

[54] TOBACCO PORTION

[75] Inventor: Martin Thal, Tullinge, Sweden

[73] Assignee: Svenska Tobaks AB, Sweden

[21] Appl. No.: 251,232

[22] Filed: Sep. 30, 1988

[30] Foreign Application Priority Data

Oct. 5, 1987 [SE] Sweden ..... 8703827

[51] Int. Cl.[5] ..... A24D 1/14

[52] U.S. Cl. ..... 131/348

[58] Field of Search ..... 131/348, 366–368; 206/265, 268; 220/83, 265

[56] References Cited

U.S. PATENT DOCUMENTS

| | | | |
|---|---|---|---|
| 1,862,133 | 6/1932 | Bayan | 131/226 X |
| 2,633,269 | 3/1953 | Hirschhorn | 131/348 X |
| 2,736,656 | 2/1956 | Marshall | 206/484 X |
| 2,745,752 | 5/1956 | Peters | 206/601 X |
| 3,054,679 | 9/1962 | Bradford | 206/558 X |
| 3,292,634 | 12/1966 | Beucler | 131/348 |
| 3,414,414 | 12/1968 | Christine et al. | 206/461 X |
| 3,491,771 | 1/1970 | Egea et al. | 131/348 X |
| 3,545,449 | 12/1970 | Pecor | 131/348 |

FOREIGN PATENT DOCUMENTS

| | | | |
|---|---|---|---|
| 742029 | 9/1966 | Canada | 131/348 |

*Primary Examiner*—V. Millin
*Assistant Examiner*—D. F. Crosby
*Attorney, Agent, or Firm*—Kinzer, Plyer, Dorn, McEachran & Jambor

[57] ABSTRACT

A tobacco portion (7) intended to be smoked in a pipe and comprising a metal-foil cup (9) whose outer shape corresponds substantially to the shape of the cavity of the pipe bowl. In order to ensure that the tobacco retains its moisture content and aromatic flavour when stored over long periods of time, the cup is isolated from atmosphere by means of removable sealing means (16, 18).

1 Claim, 1 Drawing Sheet

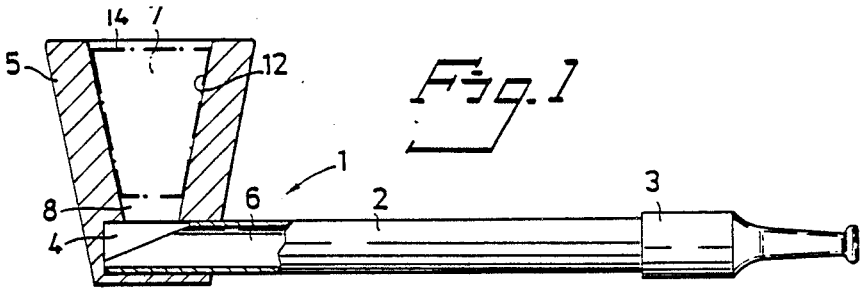
Fig. 1
Fig. 2
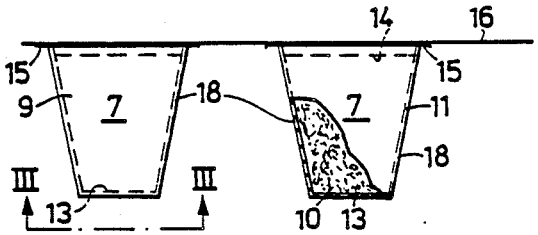
Fig. 3
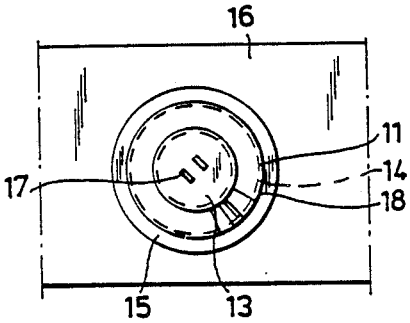
Fig. 4
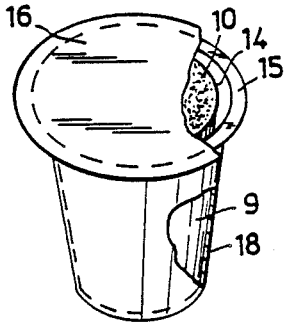
Fig. 5
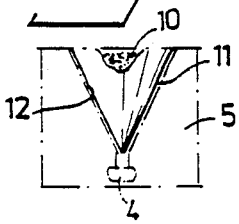

TOBACCO PORTION

This invention relates to a tobacco portion which is intended for pipe smoking and the volume or size of which corresponds to or is smaller than the internal cavity of the pipe bowl, said cavity having a cylindrical or conical inner wall.

Pipe smoking is considered to be less dangerous to the health than cigarette smoking and it it therefore important to persuade smokers to change from cigarette smoking to pipe smoking. One problem in this regard is that pipes are relatively expensive and are considered troublesome by cigarette smokers. Consequently, the use of inexpensive disposable pipes with prepacked tobacco portions for smoking with such pipes has been proposed, in an attempt to overcome these prejudices (cf. for instance DE Offenlegungsschrift No. 2,912,455). One serious drawback with pipes of this nature is that they cannot be smoked repeatedly, or at least not to any great extent, and it is therefore necessary to carry several such pipes and tobacco prepacks about one's person. Even though an endeavour is made to protect a prepacked tobacco portion by wrapping the portion in a cigarette paper or a tobacco leaf which burns together with the tobacco, it is still necessary to protect the prepack against mechanical damage. Furthermore, the prepacked tobacco portion must also be prevented from drying with a resultant loss in flavour, i.e. evaporation of the aromatic substances contained in the tobacco. In those cases when the tobacco portion is protected against mechanical damage by a cigarette-paper wrapper, the paper will impair the taste of the tobacco as it burns together with the tobacco.

Another area in which portion-packed tobacco is used is, for instance, the tobacconist's shop, where such tobacco prepacks are used as sampling items which enable a prospective customer to savour the tobacco in question. A pipe of the aforesaid kind cannot be used more than once in this particular case, since each different item of tobacco when smoked will burn the pipe bowl and leave on the bowl surface a tar and nicotine deposit which, when smoking another tobacco different to the tobacco first smoked will influence the taste of said other tobacco.

In the case of a tobacconist who wishes to offer a service which enables a pipe smoker to savour the flavour of various types of tobacco in the form of prepacked tobacco portions, it must be ensure that the tobacco will still have its original flavour and moisture content even when stored for long periods of time.

U.S. Pat. No. 3,545,449 teaches a prepackaged tobacco portion which comprises an upwardly open, airtight container made, for instance, from thin aluminium foil and with which the container opening is sealingly closed by a tear-off cover tab, which may also be made of aluminium foil. One advantage with this known prepacked tobacco portion is that because the tobacco is enclosed in a sealed and airtight container it will not lose its flavouring aromatic substances for as long as the container remains sealed or intact. This means that the holes provided in the bottom of the container in order to enable the tobacco to be smoked must also be kept sealed during storage of the tobacco portion, these holes remaining sealed until the tobacco is to be smoked. The holes can only be pierced effectively with the aid of a pointed instrument, such as a needle or the point of a knife, and the procedure required is therefore troublesome and also one which is liable to discourage the use of such prepacked tobacco portions in practice. The reason why it is necessary to use, e.g., a needle for piercing the aforesaid holes is because the metal foil from which the container is made must be very thin, so that when the prepacked tobacco portion is inserted into the pipe bowl the container can be deformed easily by finger pressure, such that the container wall will fit tightly and snugly against the inner surface of the pipe bowl and thereby prevent air from passing between said inner surface and the tobacco portion. The container must therefore be easily deformable, which in turn means that when kept, e.g. in a jacket pocket, the prepackaged tobacco portion will often become so deformed as to render if unusable. There is also risk that the cover tab will loosen from the container.

Consequently, it is an object of this invention to provide a tobacco portion which is not only ready for use immediately its seal has been broken, but which is also mechanically stable.

This object is achieved with the present invention as defined in the following claims and as described hereinafter with reference to the accompanying drawings, in which FIG. 1 illustrates a pipe which has inserted into the bowl thereof a tobacco portion composed in accordance with the invention, said pipe being shown in part section;

FIG. 2 illustrates inventive tobacco portions mounted on a strip or sheet carrier;

FIG. 3 is a view taken on the line III—III in FIG. 2;

FIG. 4 illustrates a conical tobacco portion inserted into the bowl of a pipe; and FIG. 5 illustrates a modified embodiment of a prepacked tobacco portion which is sealed against the surroundings.

The pipe 1 illustrated in FIG. 1 has a hollow stem 2 which is made of metal, plastic, paper or some other suitable material and which is provided with a mouthpiece 3, which may also be made of a plastic material. The stem 2 is fitted into a bore 4 in a pipe bowl 5. When the pipe is intended for one-time use only or for use over a single day, the bowl 5 may be made of, e.g. a paper material, so as to hold down the cost of the pipe. The inventive tobacco portions may, of course, also be smoked in a conventional and expensive pipe. As shown in FIG. 1, the end of the stem 2 inserted in the bowl 5 is beveled so that the stem channel 6 is open towards the bowl cavity 8 accomodating the tobacco portion 7. The other end of the stem channel 6 communicates with the mouthpiece 3.

FIGS. 2, 3 and 4 illustrate prepacked tobacco portions which are constructed in accordance with the invention and suited for smoking in the pipe illustrated in FIG. 1. Each tobacco portion 7 comprises a cup-shaped container 9 which is produced by shaping an impervious metal foil, e.g. aluminium foil, which will withstand the heat generated by combustion of the tobacco 10, which tobacco may completely or parially fill the container 9. The container 9 of the illustrated embodiment is of frusto-conical configuration and has a wall 11 whose shape corresponds at least substantially to the shape defined by the inner wall 12 of the bowl cavity 8. When the thin metal-foil container 9 is placed in the bowl cavity and the tobacco tamped down, the container wall 11 will deform so as to mould sealingly with the surface of the cavity wall 12, so that no air can pass between the container wall 11 and the inner cavity wall 12 and also so that heat is conducted away to the pipe bowl 5 and therewith prevent burning of the cup or container 9. The container 9 of the illustrated embodiment is made by pressing or drawing a length of foil and said container is therewith airtight. The rim of the container opening 14 remote from the container bottom 13 may be folded outwards to form a circular flange.

The bottom part of the thin, flexible metal-foil container or cup 9 has perforations 17 provided therein, and consequently it is not necessary to first perforate the bottom of the container before the tobacco can be smoked. In accordance with the concept of the invention, the tobacco-containing cup or container 9 is placed in an impervious container 18 made, e.g., of a thin plastic, metal or a plastic laminate during storage, the container 18 of the illustrated embodiment having a circular flange 15 which encircles the container opening and which is heat-sealed or glued to a cover sheet (FIG. 4), a strip (FIG. 2) or a sheet 16. The cover sheet 16 or the like may comprise a metal foil, a plastic foil or an airtight laminate, the only important requirement being that of imperviousness. The cup 9 and the cover layer 16 are joined together in a manner which enable them to be readily separated. When a plurality of tobacco portions are mounted on a strip-like cover sheet, as in the case of the embodiment illustrated in FIGS. 2 and 3, the strip may be provided with airtight weakenings, so as to form a so-called blister pack in which the seal is broken by pressing against the bottom of the outer container 18. Such packs are generally known and are used for packeting, for instance, tablets.

As will be understood, although the tobacco portion described above has been shown to have the form of a truncated cone and comprises a bottom 13 the tobacco portion may have a pointed, conical configuration in accordance with the FIG. 5 embodiment, in which case the cavity 8 of the pipe bowl must also have a corresponding shape. In the case of pipes whose bowls have a cylindrical cavity, the tobacco portion 7 will also have a cylindrical configuration.

The top of the cup 9, containing tobacco 10, is completely open and the bottom and/or wall of the cup is perforated. In order to prevent tobacco from falling out of the cup and into the outer, upwardly open and impervious container 18 when said container is kept, for instance, in a jacket pocket, the upper opening of the cup 9 should lie against or at least contiguous with the sealing cover strip or sheet 16.

I claim:

1. An individually prepackaged tobacco portion including a portion of tobacco, an inner container, an outer container and a cover, said tobacco portion located in said inner container, said inner container formed of a thin, deformable metal foil having an open top, a perforated bottom wall and an imperforate side wall, said outer container formed of an air and moisture impervious material having an open top and imperforate side and bottom walls with a flange surrounding said open top, said cover being formed of an air and moisture impervious material and being adhered to said flange of said outer container, and said inner container formed and adapted to nest in said outer container with the side and bottom walls of said inner and outer container in contact respectively with one another.

* * * * *